US005385364A

United States Patent [19]

Nussbaumer

[11] Patent Number: 5,385,364

[45] Date of Patent: Jan. 31, 1995

[54] SKI WITH SKI BINDING

[75] Inventor: Wolfgang Nussbaumer, Dornbirn, Austria

[73] Assignee: Kastle Aktiengesellschaft, Austria

[21] Appl. No.: 927,439

[22] PCT Filed: Apr. 11, 1991

[86] PCT No.: PCT/AT91/00053

§ 371 Date: Sep. 25, 1992

§ 102(e) Date: Sep. 25, 1992

[87] PCT Pub. No.: WO91/16111

PCT Pub. Date: Oct. 31, 1991

[30] Foreign Application Priority Data

Apr. 12, 1990 [AT] Austria ..... A 878/90

[51] Int. Cl.[6] ..... A63C 9/00

[52] U.S. Cl. ..... 280/607; 280/611; 280/633

[58] Field of Search ..... 280/601, 607, 609, 614, 280/615, 624, 633, 634, 809

[56] References Cited

U.S. PATENT DOCUMENTS

| | | | |
|---|---|---|---|
| 3,926,451 | 12/1975 | Guild | 280/11.35 C |
| 3,937,481 | 2/1976 | Koleda | 280/11.35 C |
| 4,022,491 | 5/1977 | Powell | 280/633 |
| 5,114,172 | 5/1992 | Rousset et al. | 280/633 |
| 5,114,173 | 5/1992 | Goud et al. | 280/633 |

FOREIGN PATENT DOCUMENTS

| | | |
|---|---|---|
| 378327 | 7/1985 | Austria . |
| 1528773 | 6/1968 | France . |
| 2565116 | 12/1985 | France . |
| 2623094 | 5/1989 | France . |
| 885675 | 2/1988 | WIPO . |

*Primary Examiner*—Richard M. Camby
*Attorney, Agent, or Firm*—Lorusso & Loud

[57] ABSTRACT

A ski with a binding in which elevated sections, project out from the ski-boot support plate in front and/or behind the binding attachment area.

21 Claims, 4 Drawing Sheets

SKI WITH SKI BINDING

Figure 1:
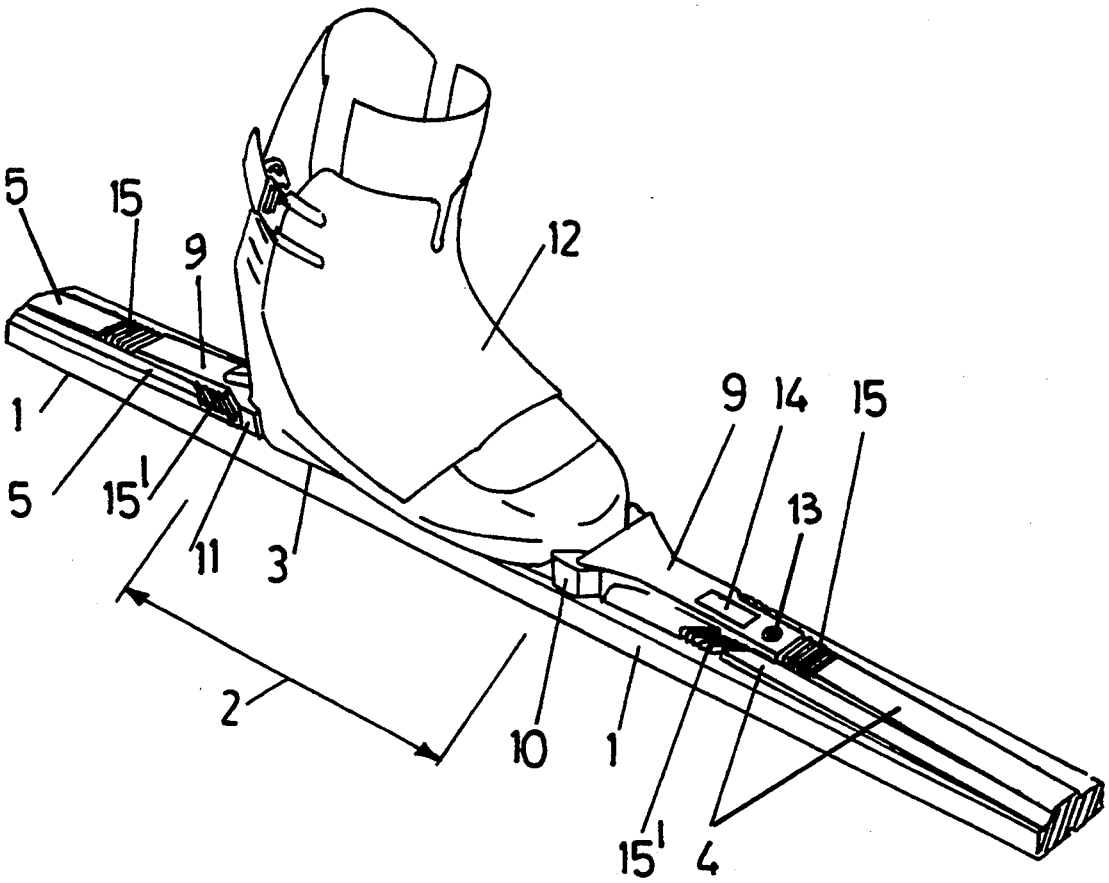

The invention relates to a ski with a ski binding, wherein provided in front of and/or behind the binding fixing region are raised portions which stick up with respect to the boot support surface and which are preferably integrated with the body of the ski, and a ski binding member is connected at least to one of said raised portions.

It has already been proposed that attachment bodies he arranged on the surface of a ski in front of the front binding or behind the rear binding, for the purposes of aerodynamically cladding the ski binding. In this connection, the suggestion has also already been put forward that the attachment bodies should be in the form of integrated components of the body of the ski and the ski binding should be connected to the attachment bodies directly or indirectly with the interposition of adaptors (French patent specification No. 1 528 773). With such a design configuration, the ski manufacturer can manufacture and sell or market a ski with a binding already integrated therein.

In the case of a ski with an integrated binding of the general kind set forth in the opening part of this specification, one difficulty is that the spacing between the raised portions in front of and behind the binding fixing region, if they are integrated with the remainder of the body of the ski, cannot be adjusted to different boot sizes.

Therefore the object of the present invention is that of providing a ski with a ski binding of the general kind set forth in the opening part of this specification, which avoids the disadvantages of the known proposals and which in particular permits adjustment of the ski binding to different boot sizes.

In accordance with the invention, that is achieved in that a component of the ski binding is guided longitudinally movably and in such a way as to be secured against lifting off, by guide surfaces which are provided in the raised portion and which are disposed at least partially over the boot support surface and which extend parallel to the longitudinal direction of the ski.

By virtue of the invention, even in the case of raised portions which are integrated with the body of the ski, it is possible to provide for adaptation to different boot sizes, for example by virtue of adjusting means for coarse and/or fine adjustment in the longitudinal direction of the ski, of the component of the ski binding which is guided in the raised portion. Apart from that, in some cases, the component of the ski binding, which is guided in the raised portion, when starting from a given longitudinal position, may perform a limited free longitudinal movement against the action of a force, for example a resilient buffer or another spring element, which is advantageous for the purposes of compensating for stresses caused by flexing of the ski which occurs in use, and for the purposes of damping the transmission of oscillations of the ski to the ski boot.

In regard to the usual trimming of a ski, it is desirable if the side guide surfaces for the component of the ski binding, which is guided in the raised portion of the body of the ski, are arranged displaced towards the centre line of the ski at a spacing from the side surfaces of the ski, and if that spacing is preferably larger than the width of the ski side plate portion beneath the raised portion. The guide surfaces for the component of the binding my form an upwardly open groove in the raised portion of the body of the ski. In that case, in order to prevent the penetration of snow into the upwardly open groove, it is advantageous if a sealing means for sealing relative to the exterior, which is variable in respect of its length, for example a bellows member, is disposed between the end of the groove which is remote from the binding fixing region and the corresponding end of the component of the binding which is guided in the groove. In general, such sealing means between the end, which is remote from the ski binding fixing region, of the component of the binding which is guided in the raised portion, and the raised portion, can be a sealing means which seals outwardly, being variable in respect of its length, for example a bellow member.

Another possible configuration provides that the guide surfaces in the raised portion of the body of the ski form a cavity which is enclosed on all sides except for an end opening. In this case, a seal can be fitted into the end opening, to embrace the component of the binding which is guided in the raised portion of the body of the ski.

The body of the ski together with the raised portions in front of and behind the binding fixing region may be enclosed by a common sheath of plastic material, for example elastomeric plastic material. In that case, guide surfaces can be formed in the raised portion of the body of the ski by the plastic material of the sheath, which is particularly advantageous when the plastic material of the sheath has good sliding properties relative to the material of the binding component which is guided in the raised portion (metal or plastic material). Otherwise it may be advantageous for one or more insert portions for example of plastic material or metal, which form at least portions of the guide surfaces, to be moulded into the raised portion of the body of the ski. In this case also, in choosing the material, attention will be directed to adequate sliding properties as between the guide surfaces and the component of the binding which is guided in those surfaces.

The component of the ski binding which is guided in the raised portion of the body of the ski may be a component which is disposed above or which stands up above the boot support surface, for example the carrier of the sole holder of the front jaw or the heel holder, and possibly also contain the release mechanism of the ski binding. As an alternative thereto, the component of the ski binding, which is guided in the raised portion of the body of the ski, may be a baseplate which accommodates the connecting members between the ski and the ski boot.

The invention is described in greater detail hereinafter by means of embodiments with reference to the drawings.

Figure 2:
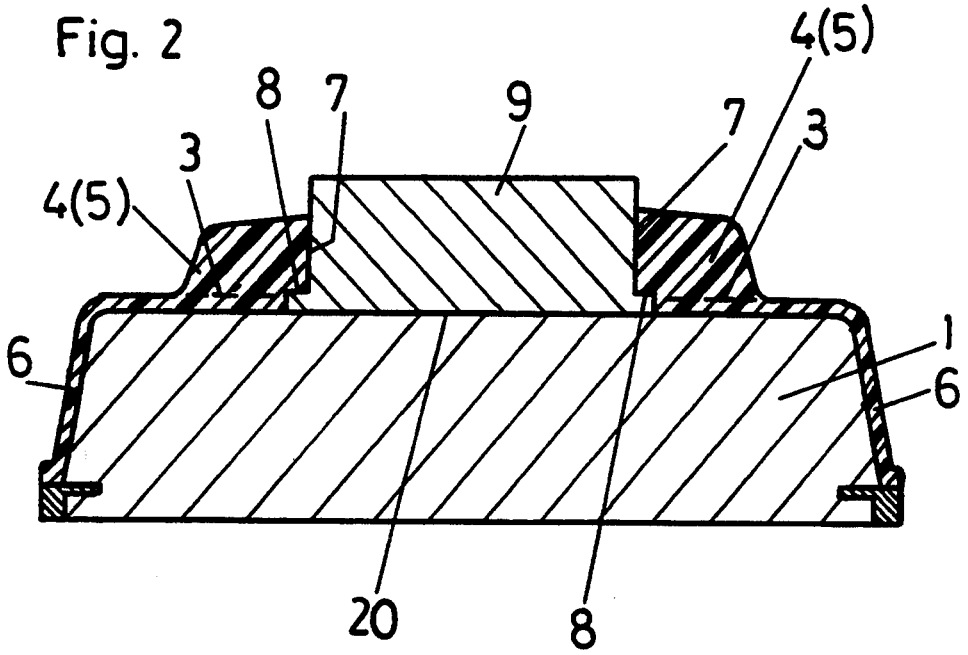
Figure 3:
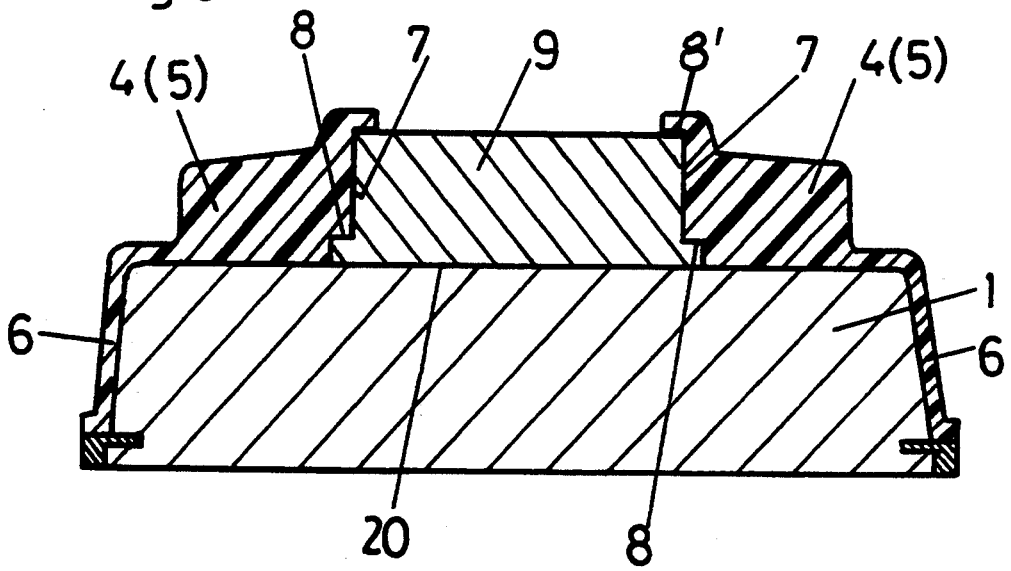
Figure 4:
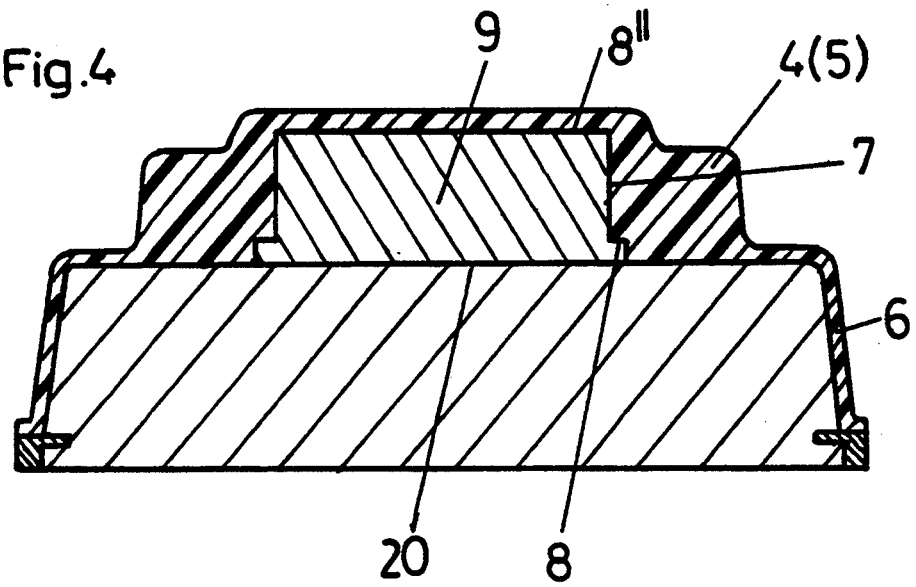
Figure 5:
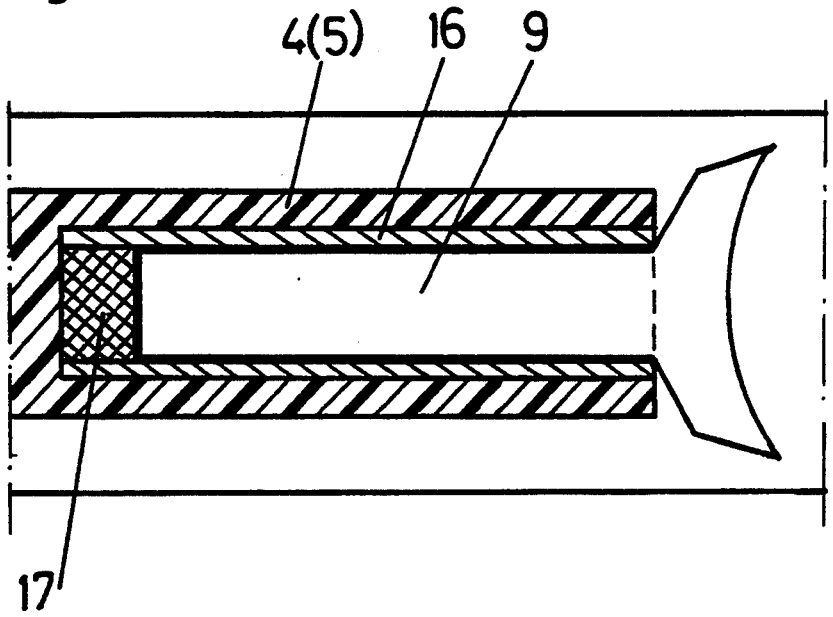
Figure 7:
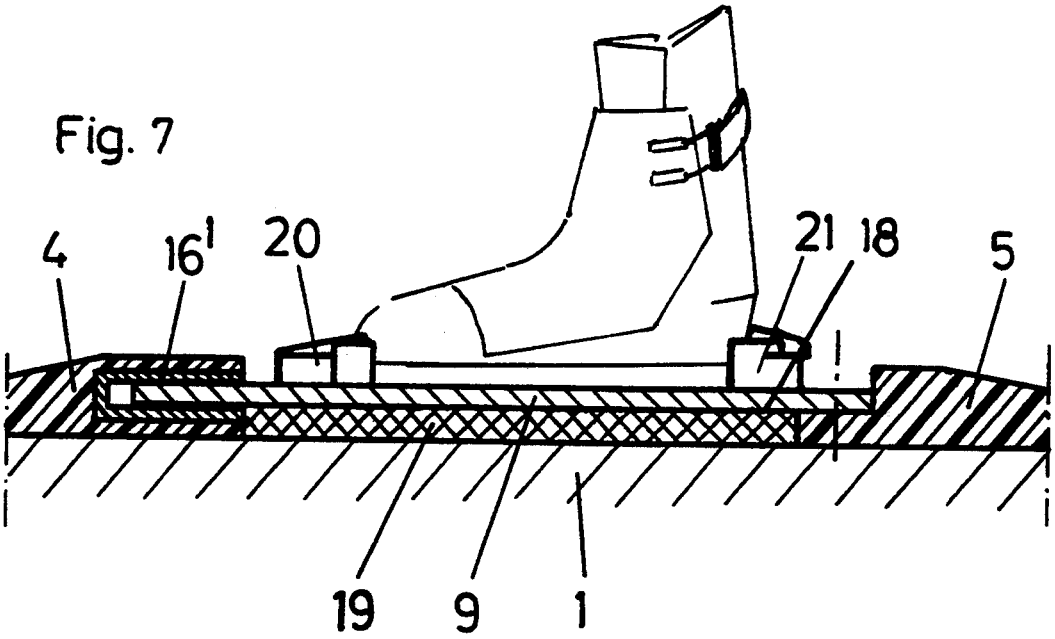
Figure 8:
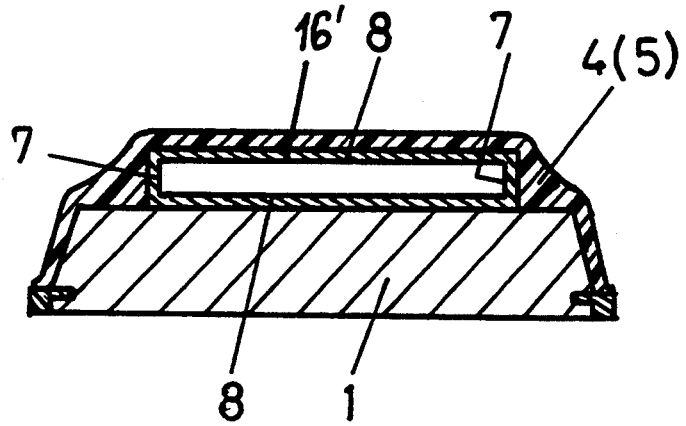

FIG. 1 is a perspective view of a ski according to the invention, with ski binding. FIGS. 2, 3 and 4 show embodiments of ski cross-sections in the region of a raised portion of the body of the ski. FIG. 5 is a plan view of a portion of the ski in a further embodiment in horizontal section, with FIG. 6 being a cross-section. FIG. 7 is a view in vertical section and FIG. 8 is a view in cross-section of a further embodiment of the invention.

FIG. 1 shows a ski in which the ski body 1, in front of and behind the binding fixing region 2, has respective raised portions 4, 5 which project above the boot support surface 3. The raised portions 4 and 5 are therefore so-to-speak "interrupted" by the binding fixing region 2 (in contrast to those ski constructions in which the entire binding fixing region is provided on a continuous raised portion). The cross-section of the ski can be of the structural configuration shown in FIG. 2 in the region of the front and rear raised portions 4, 5. Accordingly, the ski body part 1 which is continuous over the length of the ski is enclosed by a sheath of plastic material which on the one hand forms the side plate portions 6 and on the other hand the raised portions 4, 5. The portion 1 of the ski body which is beneath the raised portions 4, 5 is not shown in its details in FIG. 2 as the structure of that portion of the ski body is not an important consideration. That portion of the ski body will usually comprise upper and lower belt layers, core layers, the ground-engaging sole and the steel edges (the latter in the case of an alpine ski). In accordance with a preferred method of manufacture, the above-mentioned portion of the ski body is introduced in the form of a rough ski into a mould, whereupon, after closure of the mould, the material of the sheath is introduced into the remaining mould cavity which corresponds to the sheath. That method is known as the RIM-method (reaction-injection-moulding) by means of which for example polyurethane or its components isocyanate and polyol are injected into the mould cavity. The invention however is not restricted to that method of manufacture.

In accordance with the invention, provided on the raised portions 4 and/or 5 are guide surfaces 7, 8 which extend parallel to the longitudinal direction of the ski and which, together with the surface 20 of the ski body portion 1, serve for longitudinally guiding a component 9 of the ski binding in such a way that said component 9 is also secured against lifting off the body of the ski (by the guide surfaces 8). The side guide surfaces 7 are at a spacing towards the centre line of the ski, from the side surfaces of the ski, so that the usual trimming or waisting of the ski has no influence on the longitudinal guidance for the binding components 9. The guide surfaces 7, 8, 20 form an upwardly open groove in the raised portion 4 or 5 respectively. In the illustrated embodiment, the base guide surface 20 coincides with the surface 20 of the body portion 1 of the ski (above which the raised portions 4, 5 project). That however is not necessarily the case; on the contrary the base guide surface may also be disposed at a higher location (see for example FIGS. 6 and 8) or lower in the body portion 1 of the ski.

The component 9 of the binding, which is guided in the longitudinal direction of the ski in the raised portion 4 or 5, respectively, is in the form of a carrier for the sole holder 10 of the front jaw or the heel holder 11 for the ski boot 12, and also contains the necessary release mechanism for the front binding and the heel binding respectively. For the purposes of adaptation to different boot sizes, the binding component 9 is displaceable in the longitudinal direction of the ski, by virtue of adjusting means, for example latches or detents, at least in one of the two raised portions 4, 5, for example in the front raised portion. Adjustment of the release values of the binding or the release mechanism can be effected by way of an adjusting screw 13 or the like (such an arrangement can also be provided for the automatic heel mechanism), while a display 14 may also be provided for reading off the set release values. The groove formed by the guide surfaces 7, 8, 20 in the front raised portion 4, at the front end, in front of the front end face of the binding component 9, is covered over relative to the exterior, by a sealing means which is variable in respect of its length, for example by a bellow member 15. If the component 9 of the binding, which is disposed in the rear raised portion 5, is also displaceable or movable in the longitudinal direction of the ski, then a corresponding sealing means in the form of a bellow member 15 is also provided in the region of the groove formed in the rear raised portion by the guide surfaces 7, 8, 20. Further lateral) bellows members 15′ are provided (as can be seen from FIG. 1) because the components 9 which are guided in the raised portions 4, 5, in the region adjacent the boot, have lateral shoulders 9′ which then terminate at the lateral bellows members 15′. Those lateral shoulders cannot be seen in FIG. 2 because FIG. 2 shows a cross-section just beside the (central) bellows members 15, where the binding component no longer has any lateral shoulders.

It is not absolutely necessary for both the front binding and the rear binding to be adjustable or movable in the longitudinal direction of the ski. It is sufficient for that to be the case at the front or at the rear or if for example at the front the component 9 of the binding can be set to different boot sizes and behind the binding fixing portion 9 is freely movable against a spring force to compensate for stresses or for vibration damping purposes.

FIG. 3 shows an alternative configuration to that illustrated in FIG. 2, wherein the raised portion 4, 5 which is again formed by the plastic material of the sheath engages over the component 9 of the binding which is guided in the longitudinal direction of the ski, on both sides thereof, in the edge region, by virtue of respective narrow horizontal guide surfaces 8′. In other respects however here too the guide surfaces 7, 8, 8′, 20 form an upwardly open groove.

In contrast, in the embodiment shown in FIG. 4, the component 9 of the binding, which is guided in the raised portion 4 or 5 respectively, is arranged in a cavity which is formed by the guide surfaces 7, 8, 8″, 20 and which is enclosed on all sides except for an end opening.

In the embodiments shown in FIGS. 2 through 4, the guide surfaces 7, 8, 8′, 8″ are formed by the plastic material of the sheath. However, in insert portions may also be moulded into the raised portion 4, 5 to form the guide surfaces or portions of the guide surfaces, the insert portions being for example in the form of angular rails or bars in the transitional region from the lateral guide surfaces 7 by way of the outwardly directed horizontal guide surfaces 8 to the base guide surface 19. The rails or bars may comprise metal, possibly with a coating of a polymer anti-friction material, or they may entirely consist of particularly slidable plastic material.

Figure 6:
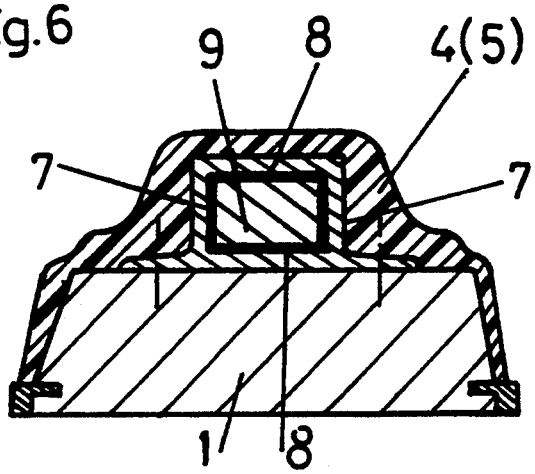

As can be seen from FIGS. 5 and 6, the insert portion, for forming the guide surfaces 7, 8 for the component 9 of the binding, which is guided in the raised portion 4, 5, may also be in the form of a sleeve 16 in which the binding component 9 is guided movably in the longitudinal direction of the ski. The embodiment shown in FIGS. 5 and 6 is not a ski binding component 9 which is adjustable to different boot sizes (such a component is to be found in the oppositely disposed raised portion 4 or 5 which is not shown), but the binding component 9 does in fact involve limited free longitudinal mobility against the force of the resilient buffer 17. The sleeve 16 can itself comprise a material with good sliding properties, for example plastic material or metal, or it can be lined with a slidable material. A seal which embraces the mouth opening of the sleeve 16 may be provided in the region of the mouth opening, for sealing relative to the binding component 9 which is longitudinally movable in the sleeve 16.

While, in the previous embodiments, the component 9 of the binding, which is guided in the raised portions 4, 5, is in the form of a carrier for the sole holder of the front jaw or a carrier for the heel holder, FIGS. 7 and 8 show an embodiment in which the component of the binding which is guided in the raised portions is in the form of a base or mounting plate for receiving a conventional front binding 10' and rear binding 11'. The baseplate 18 is fixedly connected to the rear raised portion 5 and is longitudinally movably guided at the guide surfaces 7, 8 in the front raised portion 4 or in a sleeve 16' which is inserted therein, in which respect the longitudinal mobility, as a result of the fixed fixing with the rear raised portion 5, is only slight, more specifically corresponding to the variation in the spacing between the front and rear raised portions 4, 5 in dependence on the flexing of the ski. The baseplate 18 may be underlaid with a layer 19 of visco-elastic material, for vibration damping.

The way in which the actual binding structure is designed at the binding component 9 which is guided in the raised portions 4, 5 is not subject-matter of the present invention. It may involve the known type of sole holder front jaw or automatic heel mechanism, but it may also involve binding structures which are in part also a component of the ski boot.

I claim:

1. A ski with a ski binding, comprising:

a ski shaped body having a boot support surface, a binding fixing region, and at least one raised portion integral with said ski shaped body and extending upwardly above said boot support surface;

wherein said binding fixing region includes a front and a back region, where each said raised portion is disposed on said ski shaped body so as to be proximate to at least one of said binding fixing region front and back regions;

wherein each said raised portion has at least two guide surfaces, each said guide surface extending parallel to a longitudinal axis of said ski body and being disposed so as to be at least in part above said boot support surface;

wherein the ski binding comprises a binding member having a component adapted to be guided longitudinally by said guide surfaces;

wherein said at least two guide surfaces are disposed in said raised portion so that there is an angle between said at least two guide surfaces; and wherein one of said at least two guide surfaces is disposed in said raised portion so this said one of said at least two guide surfaces secures said component from being lifted off said ski body.

2. The ski with ski binding as set forth in claim 1, wherein said guide surfaces are arranged towards a center line of the ski at a spacing from the side surfaces of the ski.

3. The ski with a ski binding as set forth in claim 1 wherein the ski further comprises means for adjusting said component in the longitudinal direction of the ski.

4. The ski with ski binding as set forth in claim 1, wherein said component has limited free longitudinal mobility against the action of a force transmitting member.

5. The ski with ski bindings as set forth in claim 1, wherein said component is disposed above said boot support surface.

6. The ski with ski binding as set forth in claim 1, wherein said component further comprising a carrier for retaining a ski boot, said ski boot having a heel and a sole.

7. The ski with ski binding as set forth in claim 1, wherein said component further comprises a baseplate for connecting the ski and said ski boot.

8. The ski with ski binding as set forth in claim 4 wherein said force transmitting member comprises a spring element.

9. The ski with ski binding as set forth in claim 6 wherein said carrier further comprises a holder for said heel, a holder for said sole, and a release mechanism.

10. The ski with ski binding of claim 1, wherein said guides surfaces form an upwardly open groove in each said raised portion, said upwardly open groove extending along said longitudinal axis and having an end remote from said binding fixing region; and in which the ski further comprises sealing means, variable in respect of its length, for sealing outwardly that portion of the groove disposed between the groove remote end and an end of said component remote from said binding fixing region.

11. The ski with ski binding of claim 1, wherein said upwardly open groove extends along said longitudinal axis and has an end remote from said binding fixing region; and in which the ski further comprises sealing means, variable in respect of its length, for sealing outwardly that portion of the groove disposed between the groove remote end and an end of said component remote from said binding fixing region.

12. A ski with a ski binding, comprising:

a ski shaped body having a boot support surface, a binding fixing region, and at least one raised portion integral with said ski shaped body and extending upwardly above said boot support surface;

wherein said binding fixing region includes a front and a back, where each said raised portion is disposed on said ski shaped body so as to be proximate to at least one of said binding fixing region front and back;

wherein each said raised portion has at least one guide surface, each said guide surface extending parallel to a longitudinal axis of said ski body and being disposed so as to be at least in part above said boot support surface;

wherein said guide surfaces in each said raised portion form an upwardly open groove;

wherein the ski binding comprises a binding member having a component adapted to be guided longitudinally by said guide surfaces; and wherein said guide surfaces secure said component from being lifted off said ski body.

13. The ski with a ski binding as set forth in claim 12, wherein said ski further comprises at least one insert part molded into said raised portions, thereby forming a portion of said guide surfaces.

14. The ski with ski binding as set forth in claim 13 wherein each said insert part is in the form of a guide rail or bar.

15. The ski with ski binding as set forth in claim 13 wherein each said insert part is in the form of a guide sleeve.

16. The ski with ski binding as set forth in claim 11, wherein said means for sealing comprises a bellows member.

17. The ski with ski binding as set forth in claim 13 wherein said at least one insert part comprises plastic.

18. The ski with ski binding as set forth in claim 13 wherein said at least one insert part comprises metal.

19. The ski with ski binding as set forth in claim 4 wherein said force transmitting member comprises a resilient buffer.

20. A ski with a ski binding, comprising:

a ski shaped body having a boot support surface, a binding fixing region, and at least one raised portion integral with said ski shaped body and extending upwardly above said boot support surface;

wherein said binding fixing region includes a front and a back, where each said raised portion is disposed on said ski shaped body so as to be proximate to at least one of said binding fixing region front and back;

wherein each said raised portion has at least one guide surface, each said guide surface extending parallel to a longitudinal axis of said ski body and being disposed so as to be at least in part above said boot support surface;

wherein the ski binding comprises a binding member having a component adapted to be guided longitudinally by said guide surfaces;

wherein said guide surfaces secure said component from being lifted off said ski body; and wherein said guide surfaces form in each said raised portion a cavity which is partially enclosed by said raised portion, said cavity having an end opening adapted to receive a seal, said seal embracing said component.

21. A ski with a ski binding, comprising:

a ski shaped body having a boot support surface, a binding fixing region, and at least one raised portion integral with said ski shaped body and extending upwardly above said boot support surface;

wherein said binding fixing region includes a front and a back, where each said raised portion is disposed on said ski shaped body so as to be proximate to at least one of said binding fixing region front and back;

wherein each said raised portion has at least one guide surface, each said guide surface extending parallel to a longitudinal axis of said ski body and being disposed so as to be at least in part above said boot support surface;

wherein the ski binding comprises a binding member having a component adapted to be guided longitudinally by said guide surfaces;

wherein said guide surfaces secure said component from being lifted off said ski body; and wherein said ski shaped body further includes a plastic sheath, said plastic sheath forming said guide surfaces.

* * * * *